United States Patent [19]

Metalsky

[11] 4,245,943

[45] Jan. 20, 1981

[54] UNLOADING APPARATUS FOR VACUUM ELECTRIC FURNACES

[75] Inventor: William J. Metalsky, Warminster, Pa.

[73] Assignee: Abar Corporation, Feasterville, Pa.

[21] Appl. No.: 25,781

[22] Filed: Apr. 2, 1979

[51] Int. Cl.[3] ..... H05B 6/26

[52] U.S. Cl. ..... 414/152; 414/157; 414/210; 13/33

[58] Field of Search ..... 414/152, 157, 173, 209, 414/210; 13/33

[56] References Cited

U.S. PATENT DOCUMENTS

| | | | |
|---|---|---|---|
| 2,582,855 | 1/1952 | Van der Pyl | 414/152 X |
| 2,940,619 | 6/1960 | Schramm et al. | 414/152 X |
| 3,573,337 | 4/1971 | Grimm et al. | 13/33 |
| 4,102,637 | 7/1978 | Kreider et al. | 13/33 X |

*Primary Examiner*—Robert W. Saifer

*Attorney, Agent, or Firm*—Zachary T. Wobensmith, 2nd; Zachary T. Wobensmith, III

[57] ABSTRACT

Unloading apparatus for vacuum electric furnaces having a hostile environment is disclosed in which a compartment is provided to which work pieces are delivered from such a vacuum electric furnace, transferred from the furnace by movable supporting and transferring arms which are normally in the hostile environment onto an elevator platform at a central location and then elevated for transfer to other equipment, all under vacuum. The movable arms are first raised and then turned by hydraulic actuators and the elevator platform is also positioned by a hydraulic actuator. The elevator platform and its enclosure are normally screened from radiant heat by a door which is swung from a vertical position for shielding to a horizontal position to permit access of the movable arms and the work pieces thereon to the elevator platform.

8 Claims, 7 Drawing Figures

UNLOADING APPARATUS FOR VACUUM ELECTRIC FURNACES

CROSS REFERENCE TO RELATED APPLICATION

The present invention is particularly useful for the unloading of a vacuum electric furnace shown and described in the application of Benjamin A. Kreider and William J. Metalsky for Vacuum Electric Furnace filed Nov. 16, 1978, Ser. No. 961,298.

BACKGROUND OF THE INVENTION

1. Field of the Invention

This invention relates to unloading apparatus for vacuum electric furnaces.

2. Description of the Prior Art

Various provisions have heretofore been made for loading and unloading vacuum electric furnaces but these have various shortcomings which delay or prolong the unloading. To our knowledge, none of the prior art devices for unloading include an unloading chamber or compartment in communication with the furnace chamber and into which work pieces are transferred from one or more of a plurality of work advancing conveyors to an elevator platform for elevation for delivery, all under vacuum.

SUMMARY OF THE INVENTION

In accordance with the invention unloading apparatus is provided for vacuum electric furnaces and more particularly for such furnaces as are disclosed in the application of Benjamin A. Kreider and William J. Metalsky, filed Nov. 16, 1978, Ser. No. 961,298. In that furnace the work is in a hostile environment above the temperature at which most metals, other than refractory metals, are stable, and in which the work is advanced step by step on a special work transferring structure of the walking beam type and with multiple paths. The unloading apparatus is not limited for use with the particular furnace but has broader applications. The work pieces are raised by arms which turn to deliver the work pieces for further movement by an elevator platform, the actuating apparatus being hydraulically actuated with cooling and with shielding of the elevator platform between transferring operations by a door movable from a vertical shielding position to a horizontal position to permit access to the elevator platform.

It is the principal object of the invention to provide unloading apparatus for vacuum electric furnaces in which the work unloading apparatus functions in a vacuum, with a plurality of arms which receive the work pieces, change the elevation of the work pieces and turn to a different location for delivery onto an elevator.

It is a further object of the invention to provide unloading apparatus for vacuum electric furnaces which is simple in construction, stable in its operation and which is free from operating difficulties.

It is a further object of the invention to provide unloading apparatus of the character aforesaid which is mounted so that it can be readily moved for inspection and maintenance, if desired.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which.

Figure 1:
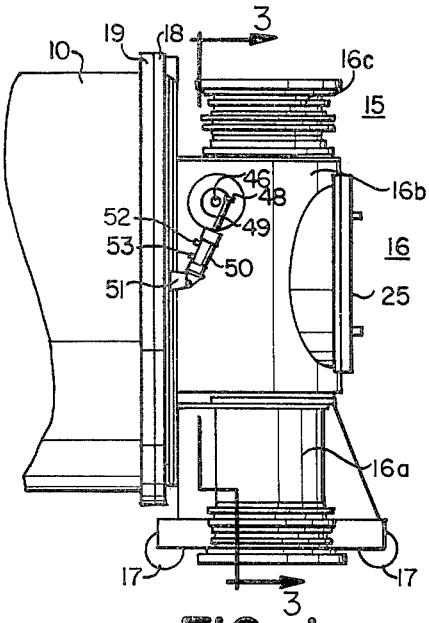
FIG. 1 is a side elevational view of the unloading apparatus of the present invention connected to the furnace to be unloaded.
Figure 2:
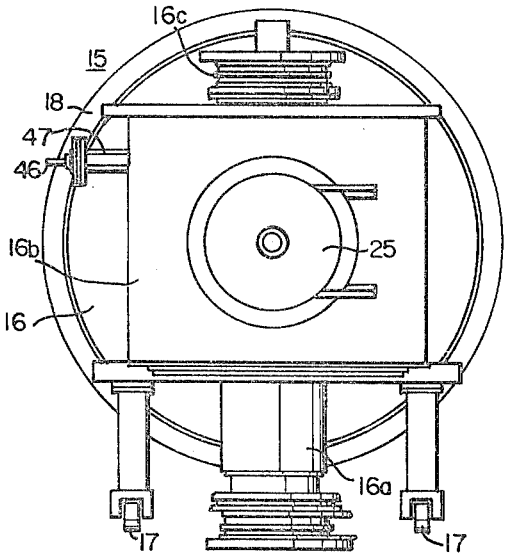
FIG. 2 is an end elevational view of the apparatus shown in FIG. 1.
Figure 3:
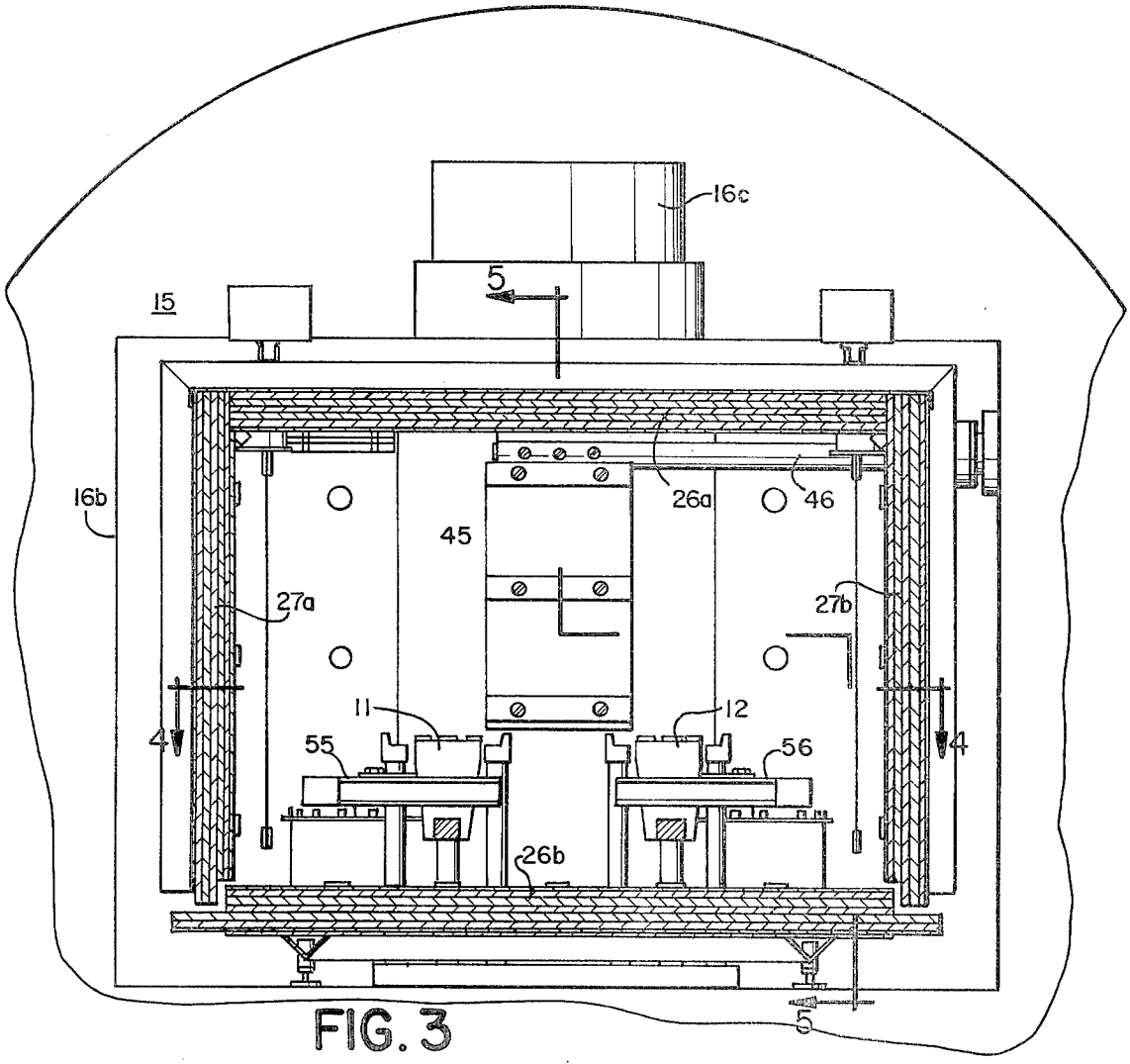
FIG. 3 is a vertical sectional view, enlarged, taken approximately on the line 3—3 of FIG. 1.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings a portion of a vacuum electric furnace is illustrated at 10 with conveyors 11 and 12 corresponding merely for purposes of illustration to those shown in the application of Benjamin A. Kreider and William J. Metalsky referred to above.

The unloading apparatus, attached to the rear end of the vacuum electric furnace is shown at 15, has an outer housing 16 which is preferably supported on wheels 17 for removal, upon disconnection of its flange 18 from the corresponding flange 19 of the furnace 10, so that access may be had to the interior of the furnace 10 for inspection and maintenance.

The housing 16 includes a lower housing section **16*a*, which is cylindrical in shape and extends below an intermediate housing section 16*b* which is semi-cylindrical in transverse cross section and carries the flange 18 and an upper housing section 16*c*** also cylindrical in shape and which communicates with the apparatus (not shown) also under vacuum for further movement of the work pieces.

The intermediate housing section **16*b* has a normally closed and sealed door 25 for access to the interior of the housing 16** for maintenance and repair.

The intermediate housing section **16*b* has a heat insulating lining with top and bottom wall sections 26*a* and 26*b*, side wall sections 27*a* and 27*b* continuous with the insulating lining of the furnace 10, and a removable rear wall section 28**.

The rear wall section 28 has a vertical hollow cylindrical elevator housing 30 therein. The housing 30 has vertically movable therein an elevator platform 31 movable by a motor actuated plunger 32.

The elevator housing 30 has an opening 40 in the front thereof for movement of work pieces into the interior for transfer onto the platform 31 in its lowered position and has side slots 42 for reception of the transferring apparatus.

A radiation blocking door or shield 45 is provided, and carried by a shaft 46. The shaft 46 extends through a seal 47 for actuation by an arm 48 having a piston rod 49 connected thereto from a piston (not shown) in a cylinder 50 pivotally mounted on a bracket 51 on the flange 18. The cylinder 50 has fluid connections 52 and 53 for applying fluid pressure in the cylinder 50 for moving the piston therein.

Figure 4:
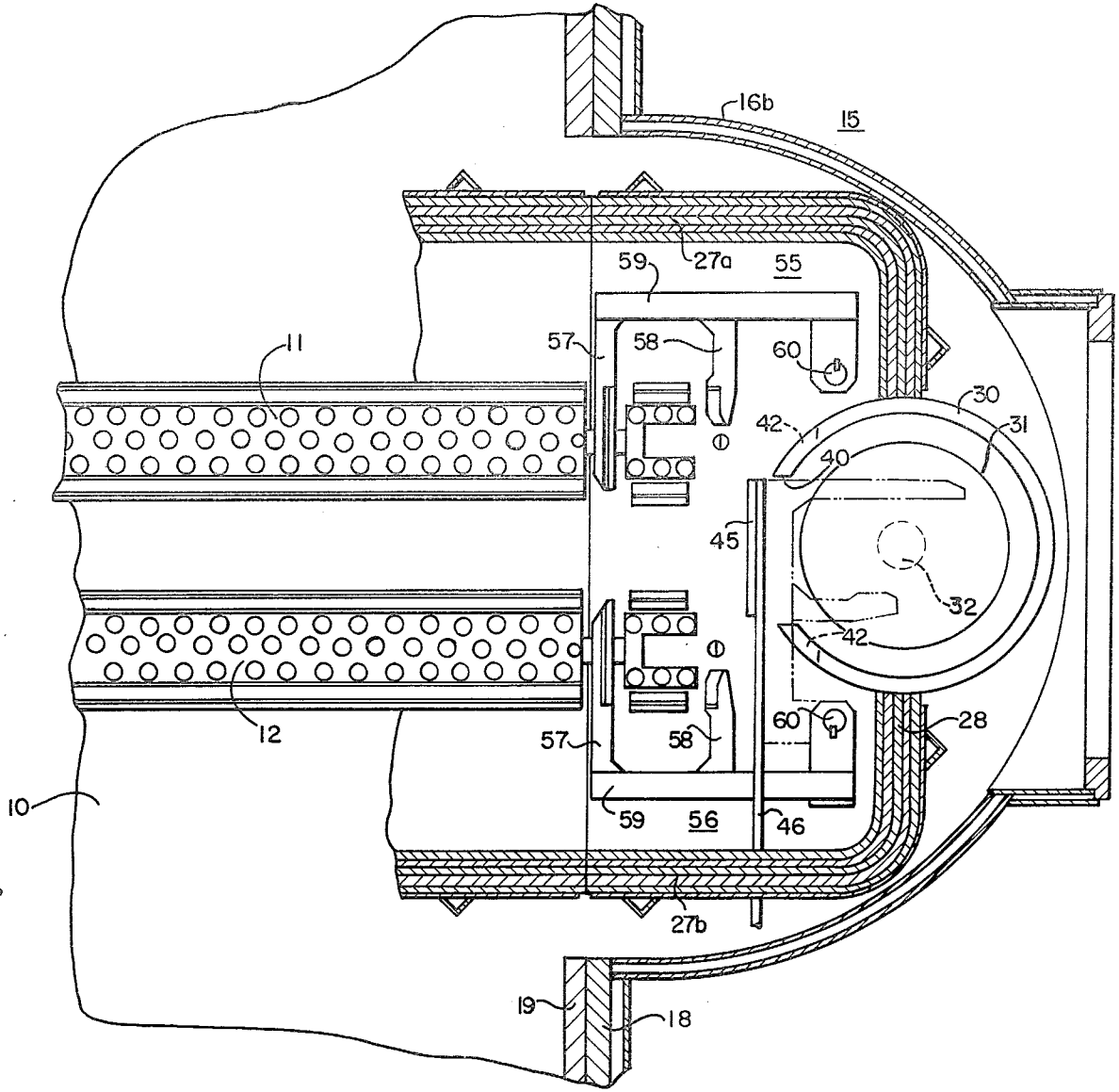
FIG. 4 is a horizontal sectional view taken approximately on the line 4—4 of FIG. 3.
Figure 5:
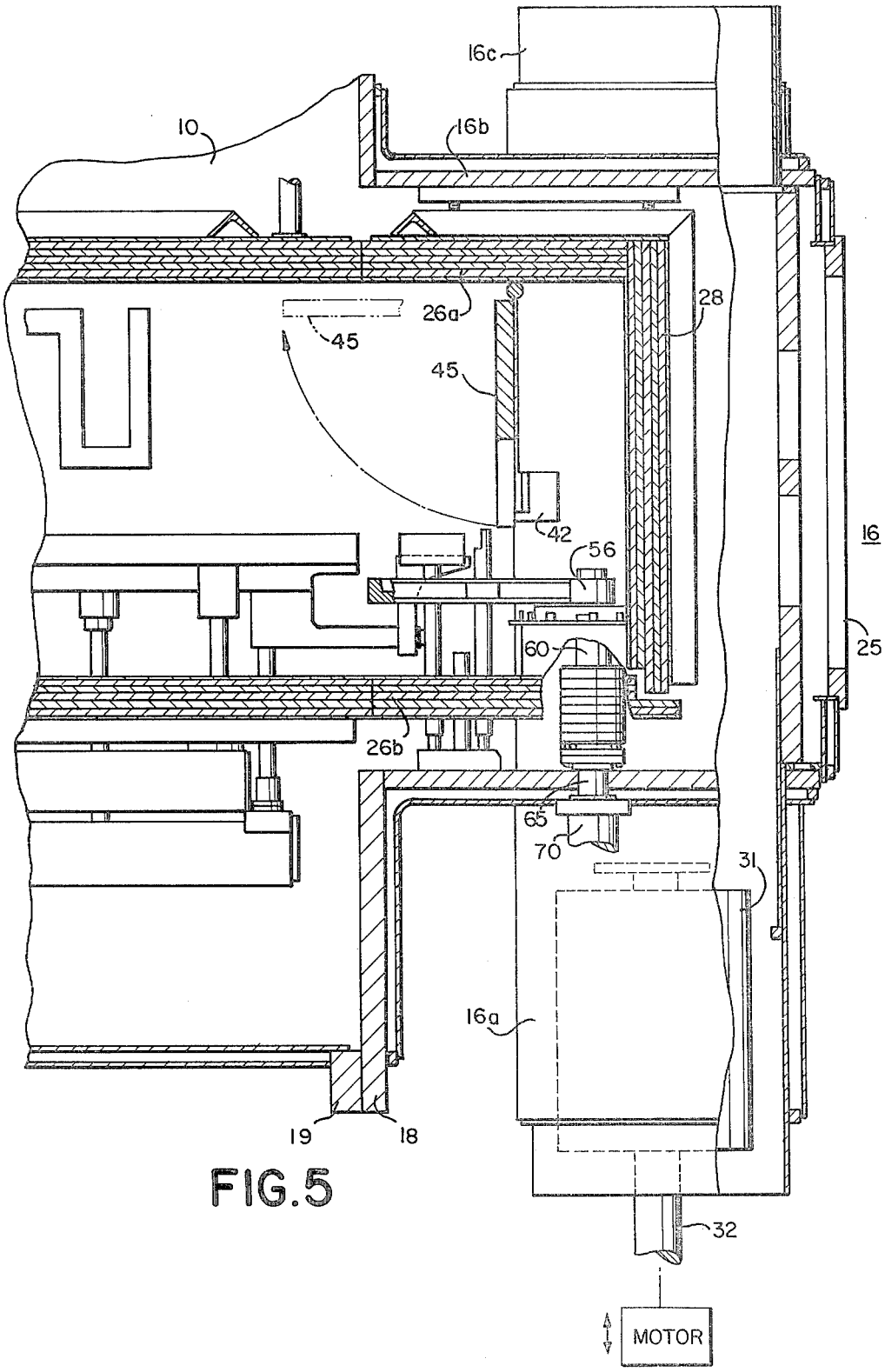
FIG. 5 is a vertical sectional view taken approximately on the line 5—5 of FIG. 3.
Figure 6:
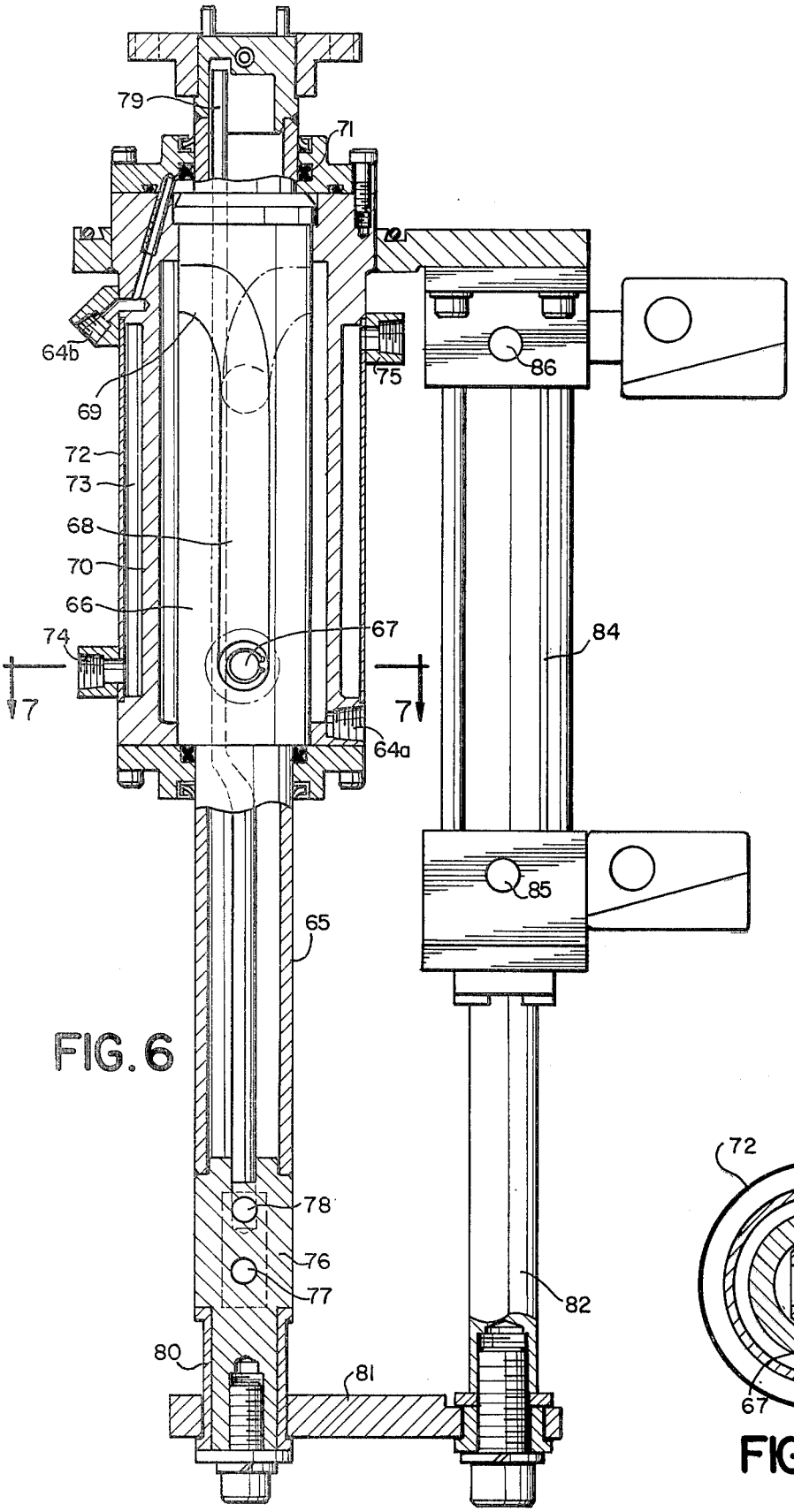
FIG. 6 is an enlarged vertical sectional view of one of the arm actuators.
Figure 7:
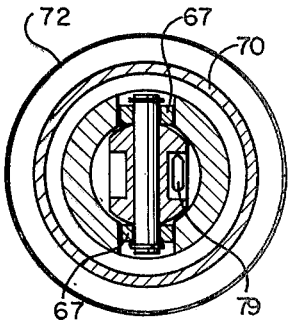
FIG. 7 is a horizontal sectional view taken on the line 7—7 of FIG. 6, partially rotated.

In order to transfer the work pieces from the conveyors 11 and 12 to the elevator platform 31, transfer arms 55 and 56 are provided each having spaced horizontal fork tines 57 and 58 carried on a fork bar 59. The fork bar 59 is keyed to a shaft 60. Each of the shafts 60 (see FIGS. 5, 6, and 7) is mounted on a hollow plunger 65 which is carried within a barrel type cam 66. The plunger 65 has opposite cam followers 67 engaged in grooves in the barrel cam 66 each having a vertical groove portion 68 and a helical groove portion 69 for rotating its shaft 60 through an angle of 90°. The helical portion 69 for the transfer arm 55 causes the arm 55 to move counterclockwise (see FIG. 4) while the helical portion for the arm 56 causes the arm 56 to move clockwise to transfer work pieces on the conveyors 11 and 12 into the elevator housing 30 and onto the platform 31 for elevation by the platform 31.

The plunger 65 is vertically movable within a cylinder 70 with vacuum and oil seals 71 at each end. The space between the cylinder 70 and the plunger 65 is preferably oil filled through normally closed oil filling connections 64*a* and 64*b*. Exteriorly of the cylinder 70 a casing 72 is provided bounding a space 73 for water cooling with a lower water inlet 74 and an upper water outlet 75.

The plunger 65 is closed at its lower end by a fitting 76 with a water inlet connection 77 to the interior of the plunger 65 at the bottom and a water outlet connection 78 to which a pipe 79 is connected from the top of the interior of the plunger 65. The fitting 76 is carried in a sleeve 80 which is mounted on an actuating connector 81 for actuation by a piston rod 82 secured to the connector 81. The piston rod 82 is connected to a piston (not shown) in a hydraulic cylinder 84 which is secured to the bottom of the exterior of the housing section 16*b*. The cylinder 84 has fluid connections 85 and 86 for delivery of fluid to opposite ends of the cylinder 84.

The mode of operation will now be pointed out.

When the work pieces in the furnace 10 have been advanced by the conveyors 11 and 12 to their rearmost positions within the furnace 10 the shield 45 is then raised from its vertical to its horizontal position by actuation of the shaft 46 by the arm 48 and piston rod 49 by the fluid pressure in the cylinder 50.

The transfer arms 55 and 56 are then successively operated in the desired sequence through the cylinders 84, the piston rods 82, the connectors 81 and the plungers 65 to first raise the arms 55 and 56 by engagement of the cam followers 67 in their respective vertical groove portions 68 and then to turn the arms 55 and 56 to deliver the work pieces into the interior of the elevator housing 30 and onto the elevator platform 31 at a precise location. The arms 55 and 56 are then retracted by a reverse of the action just described and returned to their initial positions for receiving the next advancing work pieces on the conveyors 11 and 12.

The shield 45 is then returned to its initial position by actuation of the clyinder 50.

The elevator platform 31 is then raised for the delivery of the work piece thereon for removal, all still within the vacuum conditions prevailing in the furnace.

The operations of raising the shield 45, moving a work piece by one of the transfer arms 55 or 56, lowering the shield 45, and raising the work piece for removal are repeated as desired and in the proper sequence.

It will be noted that the actuating mechanism for the transfer arms 55 and 56 is internally and externally water cooled to prevent overheating and to reduce undesired expansion and contraction.

I claim:

1. Unloading apparatus for vacuum electric furnaces having a conveyor for advance of work pieces therein,
- a housing in communication with the interior of the furnace,
- an elevator housing within said first mentioned housing and having an opening therein for transfer thereinto of a work piece,
- a movable shielding means for shielding said opening and having one position for shielding and another position for work piece transfer,
- said elevator housing having an elevator platform therein,
- means for raising and lowering said elevator platform for delivery of a work piece, and
- means for transferring a work piece from said conveyor to said elevator platform with said shielding means in its work transfer position.

2. Apparatus as defined in claim 1 in which
- said work transferring means comprises
  - a transfer arm movable from a position for receiving a work piece on said conveyor to a position for delivering the work piece onto said elevator platform.

3. Apparatus as defined in claim 2 in which
- said work transferring means comprises operating members for said transfer arm for raising said arm and turning said arm upon its upward movement for entry into said elevator housing.

4. Apparatus as defined in claim 3 in which
- said operating members have provisions for water cooling thereof.

5. Apparatus as defined in claim 2 in which
- said operating members comprise a plunger connected to said transfer arm and a cam member for controlling the positioning of said transfer arm.

6. Apparatus as defined in claim 2 in which
- a plurality of conveyors are provided,
- a transfer arm is provided for each conveyor, and
- separate operating members are provided for each of said transfer arms.

7. Apparatus as defined in claim 1 in which
- said shielding means comprises a shielding member supported on a pivotally mounted shaft in said first mentioned housing, and
- exteriorly disposed operating members are provided for said shaft.

8. Apparatus as defined in claim 1 in which
- said means for raising and lowering said elevator platform is motor operated.

* * * * *